US006475341B1

(12) United States Patent
Johnston et al.

(10) Patent No.: US 6,475,341 B1
(45) Date of Patent: Nov. 5, 2002

(54) PROCESS FOR MAKING PAPER

(75) Inventors: Howard Johnston, Mirfield; Lesley Collett, Dewsbury, both of (GB)

(73) Assignee: Ciba Specialty Chemicals Water Treatments Ltd., West Yorkshire (GB)

( * ) Notice: Subject to any disclaimer, the term of this patent is extended or adjusted under 35 U.S.C. 154(b) by 0 days.

(21) Appl. No.: 09/485,431

(22) PCT Filed: Sep. 7, 1998

(86) PCT No.: PCT/GB98/02688

§ 371 (c)(1),
(2), (4) Date: Feb. 9, 2000

(87) PCT Pub. No.: WO99/14432

PCT Pub. Date: Mar. 25, 1999

(30) Foreign Application Priority Data

Sep. 12, 1997 (GB) ..... 9719472

(51) Int. Cl.[7] ..... D21H 23/76; D21H 17/26; D21H 17/28; D21H 17/31; D21H 17/36; D21H 17/45; D21H 17/55

(52) U.S. Cl. ..... 162/183; 162/158; 162/168.1; 162/168.3; 162/175; 162/178; 162/181.2; 162/181.3; 162/181.8

(58) Field of Search ..... 162/158, 168.1, 162/168.2–168.3, 170, 173, 175–178, 179, 183, 181.1, 181.2–181.8

(56) References Cited

U.S. PATENT DOCUMENTS

| | | | | | |
|---|---|---|---|---|---|
| 4,753,710 | A | * | 6/1988 | Langley et al. | 162/164.3 |
| 4,913,775 | A | | 4/1990 | Langley et al. | |
| 5,015,334 | A | * | 5/1991 | Derrick | 162/168.1 |
| 5,104,487 | A | | 4/1992 | Taggart et al. | |
| 5,126,014 | A | * | 6/1992 | Chung | 162/164.6 |
| 5,167,766 | A | | 12/1992 | Honig et al. | 162/164.1 |
| 5,185,062 | A | * | 2/1993 | Begala | 162/168.1 |
| 5,232,553 | A | * | 8/1993 | Smigo et al. | 162/147 |
| 5,274,055 | A | | 12/1993 | Honig et al. | 524/47 |
| 5,431,783 | A | * | 7/1995 | Honig | 162/164.1 |
| 5,502,091 | A | * | 3/1996 | Dasgupta | 524/55 |
| 5,514,249 | A | * | 5/1996 | Cauley et al. | 162/164.1 |
| 5,595,629 | A | * | 1/1997 | Begala | 162/158 |
| 5,626,721 | A | * | 5/1997 | Rushmere et al. | 162/181.6 |
| 5,942,086 | A | * | 8/1999 | Owen | 162/135 |

FOREIGN PATENT DOCUMENTS

| | | |
|---|---|---|
| EP | 0 548 960 | 6/1993 |
| GB | 2 292 394 | 2/1996 |
| WO | 93/01353 | 1/1993 |
| WO | 95 33096 | 12/1995 |
| WO | 98/29604 | 7/1998 |

OTHER PUBLICATIONS

D. Eklund & T. Lindström, "Paper Chemistry, an Indroduction" 1991, DT Paper Science, 1st edition, pp. 145–190.*

Derwent Abst. 1991–291900[40] of JP 03 193 996.

* cited by examiner

*Primary Examiner*—Jose Fortuna
(74) *Attorney, Agent, or Firm*—David R. Crichton

(57) ABSTRACT

Paper is made by mixing anionic starch, carboxyl methyl cellulose or other polymeric binder into a cellulosic thin stock together with a cationic inorganic or polymeric coagulant and then flocculating the suspension by means of an anionic swelling clay or other anionic retention aid.

9 Claims, No Drawings

PROCESS FOR MAKING PAPER

This invention relates to processes for making paper (by which we include paper board), and in particular processes of making paper which is strengthened by starch.

It is standard practice to make paper by a process comprising flocculating a cellulosic suspension by the addition of a high molecular weight, polymeric, retention aid, draining the flocculated suspension through a wire to form a wet sheet, and drying the sheet.

One particular class of paper-making processes are microparticulate processes in which the flocculation with polymeric retention aid is followed by degrading the flocs by agitation and then reflocculating by the addition of a microparticulate material, such as bentonite.

It is well known to include low molecular weight cationic polymer in the suspension, either by addition at the thick stock stage or subsequently, in various paper-making processes for various purposes. It is also well known to include inorganic coagulants such as poly aluminium chloride or alum for various purposes. Reference is made to, for instance, U.S. Pat. No. 4,913,775 for a description of various processes and, in particular, a microparticulate process sold under the trade name Hydrocol.

It is known to add cationic starch to the cellulosic suspension in papermaking processes as a strengthening aid, and in some processes it also contributes to retention. Processes have also been described which comprise addition of raw, untreated starch to the cellulosic suspension. Processes in which starch is added to the cellulosic suspension generally tend to have the disadvantage that particular care must be taken to ensure good retention of starch so that there are not significant levels of dissolved or undissolved starch in the whitewater draining through the wire. See for instance WO95/33096.

Processes are described in GB 2,292,394 in which anionic starch, carboxy methyl cellulose or other polymeric binder capable of hydrogen bonding to cellulose are added to the thin stock with a cationic polymer which has a molecular weight above 150,000, preferably 1 million or more and which insolubilises the anionic binder. Cationic starch can also be added.

Processes are described in WO93/01353 in which an anionic retention aid based on starch, a cellulosic derivative or guar gum free of cationic groups and an aluminium compound are added to the suspension. Another disclosure of processes in which an anionic compound and a low molecular weight cationic polymer are added to the suspension is in JP-A-03193996.

Although various processes which are known can be optimised to give useful strength in the dry sheet and can be optimised to give satisfactory short drainage times and/or good retention of the fibres and/or the binder, it would be desirable to be able to provide a process which gives optimum utilisation of the binder in the sheet (and thus optimum strength) together with good retention of the binder, the fibres and the fines in the cellulosic suspension, and good drainage properties.

It might have been thought that these objectives could be achieved by modifying the process described in GB 2,292,394 by adding a high molecular weight cationic polymeric retention aid to the suspension, but we have found that this does not give any significant or useful improvement.

According to the invention, a process for making paper (including paper board) comprises providing a thin stock suspension of cellulosic fibres, mixing into this suspension (a) a water soluble anionic or non-ionic polymeric binder and (b) a water soluble cationic material selected from water soluble organic polymeric coagulants having intrinsic viscosity not more than 3 dl/g and inorganic coagulants, then flocculating the suspension by mixing into the suspension an anionic retention aid (which may be a microparticulate anionic retention aid), draining the flocculated suspension to form a wet sheet, and drying the wet sheet.

We have surprisingly found that the addition of the anionic retention aid, instead of traditional cationic polymeric flocculants, after addition of the binder and cationic polymeric coagulant, gives good flocculation of the suspension and subsequently a marked improvement in the drainage rate and good retention of fibre and fines. Further, it does not lead to any significant deterioration in the retention of binder and so gives good retention of the binder.

The cellulosic suspension may be any conventional thin stock formed from any conventional cellulosic feed, including recycled feed material. The thin stock may be substantially unfilled (i.e., without the deliberate addition of significant amounts of filler) or it may be filled.

The binder is a water soluble material capable of substantial hydrogen bonding with cellulose. That is, it is capable of binding with the cellulose fibres in the paper stock, for instance to levels of at least 1 or 2% (dry binder based on dry stock), often with a binder retention of at least about 60 or 70 or even 80%. In practice the binder needs to be non-ionic or anionic, since if it is cationic then the binding of the binder to the cellulosic fibres will predominantly be due to the cationic groups rather than due to hydrogen bonding. In order that hydrogen bonding predominates, the non-ionic or anionic binder will normally be a polyhydroxy material. In order that it acts as a binder in the final sheet, thereby increasing the strength of the sheet, it must be polymeric and of high molecular weight. Thus the molecular weight will normally be in excess of 5,000, and often in excess of 50,000 and generally above 100,000.

In practice, the polymeric binder is usually a cellulosic compound, a natural gum or a starch, but it can be a synthetic polymer such as polyvinyl alcohol. Natural and modified natural polymers include cellulosics, gums and starches, for instance carboxymethyl cellulose, xanthan gum, guar gum, mannogalactans and, preferably, anionic starch. The binder preferably has a pendant ionisable group which is generally sulphate, carboxylate or phosphate. Suitable starches include oxidised starch, phosphate starch and carboxy methylated starch.

The amount of binder is normally at least about 1% (dry weight binder based on dry weight suspension) and can be up to, for instance, 10%. Generally it is 1 to 8%, preferably around 3%, for instance 3 to 5% (i.e., 30 to 50 kg/t).

The cationic material is preferably a cationic polymeric coagulant which has IV not more than 3 dl/g. In this specification IV is intrinsic viscosity measured by suspended level viscometer at 25° C. in 1N sodium chloride buffered to pH 7. Preferably IV is not more than 2 dl/g, for instance 1.5 dl/g or below. Normally it is at least 0.1 or 0.5 dl/g. Preferred cationic polymeric coagulants have high charge density, for instance above 3 meq/g and usually above 4 meq/g.

Inorganic coagulant such as aluminium compounds, for instance poly aluminium chloride, can be used alone as the water soluble cationic material, or in combination with the polymeric coagulant.

The preferred cationic polymeric coagulants are materials such as polyethylene imines or polyamines (both preferably being fully quaternised), dicyandiamide condensation polymers (usually being substantially fully quaternised or in salt form) and polymers of water soluble ethylenically unsaturated monomer or monomer blend which is formed of 50 to 100 mole percent cationic monomer and 0 to 50 mole percent other monomer. The amount of cationic monomer is usually at least 80 to 90 mole percent, and homopolymers are often preferred. Ethylenically unsaturated cationic monomers that can be used include dialkylaminoalkyl (meth)-acrylates and -acrylamides (usually in quaternary or other salt form) and diallyl dialkyl ammonium chloride, for instance diallyl dimethyl ammonium chloride (DADMAC). Particularly preferred polymers are DADMAC homopolymers and copolymers.

When the polymer is a copolymer, the comonomer is usually acrylamide, or other water soluble non-ionic ethylenically unsaturated monomer.

The cationic polymeric coagulant may be a linear polymer. Alternatively it may be produced in the presence of multifunctional additives which produce structure, for instance polyethylenically unsaturated monomers such as tetraallyl ammonium chloride, methylene bis acrylamide and multifunctional monomer included in the polymer chain. The amount of these additives, if used, is generally at least 10 ppm and usually at least 50 ppm. It may be up to 200 or 500 ppm.

The amount of cationic material is normally an excess over that amount which is required to give observable retention when the anionic retention aid is added. The amount may be sufficient to cause the suspension to have a zeta potential which is around zero or is positive, but satisfactory retention is often obtainable even though the zeta potential is slightly negative. In practice, the amount of cationic material is best determined by forming a thin stock containing the desired amount of the binder (having regard to the strength properties that are required) and then observing the retention effect upon adding the retention aid after adding various amounts of the cationic material.

It is usually undesirable for the cationic material to include any significant amount, or indeed any amount, of high molecular weight cationic polymeric material (for instance intrinsic viscosity above 4 dl/g) since the use of such a material does not usually cause any improvement in performance, provided sufficient cationic material which is inorganic and/or low molecular weight has been used. However, if desired, other materials can be added with or after the cationic polymeric or inorganic coagulants discussed above, provided these extra materials do not interfere with the process.

The amount of cationic polymeric coagulant is normally from 0.25 to 10 kg active polymer per ton dry cellulosic suspension, preferably 1 to 3 kg/t.

In the process the binder may be added prior to the cationic coagulant or after the cationic coagulant. The binder and coagulant may be added essentially simultaneously. The coagulant may be added as a single dose or as a split dose, for instance partially before and partially after the binder. The order of addition of the binder and cationic coagulant can be varied as convenient without significant deterioration in results.

After treatment of the suspension with the binder and cationic polymeric coagulant, the anionic retention aid is mixed into the treated suspension. This mixing may be done under medium or high shear, but is normally done under sufficient force simply to mix the anionic retention aid into the suspension, for instance at the headbox or prior to it.

The amount of anionic retention aid is normally 0.5 to 10 kg/t dry cellulosic suspension, preferably 1 to 4 kg/t.

The anionic retention aid is a material which acts to flocculate the treated thinstock suspension and thus improve the drainage in comparison with a non-flocculated treated thinstock suspension.

It may be a substantially water soluble anionic polymeric material and thus it may be, for instance, a material as described in WO98/29604.

Preferably, however, it is a microparticulate anionic retention aid which may be inorganic or organic. For instance, it may be an organic anionic microparticulate retention aid such as described in U.S. Pat. Nos. 5,167,766 and 5,274,055. Preferably it is an inorganic anionic microparticulate retention aid. Such materials are well known and include swelling clays, generally referred to as bentonite, colloidal silica, polysilicic acid, polysilicic acid or polysilicate microgels, and aluminium modified versions of these. Mixtures may be used, e.g., of organic and inorganic microparticles.

Preferably no additional components are added to the cellulosic suspension after treatment with binder and cationic coagulant and before addition of anionic retention aid.

After treatment with the anionic retention aid the flocculated suspension is drained through a wire to form a wet sheet. The wet sheet is then dried in standard manner to form a dry paper (including paper board) sheet.

In the process the retention of binder in the sheet is preferably at least 60 or 70%, more preferably at least 80%, and even 85 or 90% or above.

In the invention we also provide the use of an anionic retention aid as discussed above to improve the drainage of a cellulosic suspension which has been treated with binder and cationic polymeric coagulant, of the types discussed above.

In the process we often find that drainage times for a given volume of backwater can be reduced to 70 or 60% of drainage times under equivalent conditions but without addition of anionic retention aid, and may even be reduced to below 50 or 40% of these times.

The invention will now be illustrated with reference to the following examples.

EXAMPLES

For each test 1 liter of cellulosic stock was used, at a concentration of 0.5% solids. For each process anionic starch was added as the binder at a level of 3% followed by Polymer A at the dosage given in the tables below. In some tests subsequent materials were added in the dosages given below in the tables.

Polymer A was a polyDADMAC homopolymer of IV about 1 dl/g.

A drainage test was carried out and the time for collection of 600 ml of backwater was measured. This was the drainage time. Results are shown in Tables 1 to 3 below.

TABLE 1

Evaluation of single addition of Polymer A

| Starch Dosage (%) | Polymer A Dosage (kg/t) Active | Drainage time (seconds) |
|---|---|---|
| 3 | 0 | 20 |
| 3 | 0.8 | 7 |
| 3 | 1.6 | 7 |
| 3 | 3.2 | 11 |

TABLE 2

Effect of a high molecular weight flocculant

| Starch Dosage (%) | Polymer A dosage (kg/t) active | Flocculant addition (g/t) active | Drainage time (seconds) |
|---|---|---|---|
| 3 | 1.6 | 0 | 7 |
| 3 | 1.6 | low cationic-200 | 8 |
| 3 | 1.6 | medium cationic-200 | 9 |
| 3 | 1.6 | low anionic-200 | 6 |

TABLE 3

Effect of sodium bentonite

| Starch Dosage (%) | Polymer A active (kg/t) | Bentonite dosage (kg/t) active | Drainage time (seconds) |
|---|---|---|---|
| 3 | 1.6 | 0 | 7 |
| 3 | 1.6 | 1 | 2 |
| 3 | 1.6 | 2 | 3 |

It can be seen that good drainage results are obtained with the use of Polymer A alone, and no significant improvement is seen with the subsequent addition of various high molecular weight flocculants. However, when sodium bentonite is added after the Polymer A, there is a significant improvement in the free drainage time, to values much lower than expected.

EXAMPLE 2

These tests show the good starch retention which is obtained using the system of the invention. In this test the same furnish as in Example 1 is used. To this is added anionic starch at a level of 3% dry starch on dry fibre. Subsequently a cationic coagulant is added. In some systems (those of the invention) a further component, the anionic retention aid, is then added. Dosages and results are shown in Table 4 below.

TABLE 4

| Coagulant | Coagulant Dosage (kg/t) | Anionic Retention Aid (if used) | Retention Aid Dosage (kg/t) | Starch Retention (%) |
|---|---|---|---|---|
| Polymer B | 0.6 | | | 67 |
| | 0.8 | | | 90 |
| | 1.2 | | | 93 |
| | 1.6 | | | 94 |
| | 2.0 | | | 86 |
| | 2.4 | | | 85 |
| | 3.6 | | | 84 |
| Polymer B | 1.2 | Sodium | 2.4 | 91 |
| | 0.6 | bentonite | 2.4 | 81 |
| | 1.2 | | 1.2 | 91 |

Polymer B is a polyDADMAC homopolymer of IV about 2 dl/g.

What is claimed is:

1. A process for making paper comprising providing a thin stock suspension of cellulosic fibres, mixing into the suspension (a) a water soluble anionic or non-ionic polymeric binder and (b) a water soluble cationic material selected from water soluble organic polymeric coagulants having intrinsic viscosity below 3 dl/g and a charge density of above 3 meq/g, and inorganic coagulants, then flocculating the suspension by mixing into the suspension an anionic retention aid, draining the flocculated suspension to form a wet sheet, and drying the wet sheet.

2. A process according to claim 1 in which the anionic or non-ionic polymeric binder is a binder capable of substantial hydrogen bonding with cellulose.

3. A process according to claim 1 in which the polymeric binder is selected from cellulosic compounds, natural gums, starches and polyvinyl alcohol.

4. A process according to claim 1 in which the polymeric binder is selected from anionic starch and carboxyl methyl cellulose.

5. A process according to claim 1 in which the cationic polymer is selected from polyethylene imines, polyamines, dicyandiamide polymers, and polymers of water soluble ethylenically unsaturated monomer or monomer blend comprising 50 to 100 mole percent cationic monomer and 0 to 50 mole percent other monomer.

6. A process according to claim 5 in which the cationic polymer is a polymer of monomers comprising water soluble polyethylenically unsaturated monomer.

7. A process according to claim 1 in which the water soluble cationic material is a polymer of 80 to 100% diallyl dimethyl ammonium chloride and 0 to 20% acrylamide and having intrinsic viscosity below 3 dl/g.

8. A process according to claim 1 in which the anionic retention aid is selected from inorganic swelling clays, colloidal silica, polysilicic acid and silicate microgels, aluminium modified colloidal silica or polysilicic acid or polysilicate microgels, and organic microparticles.

9. A process according to claim 1 in which the binder is selected from anionic starch and carboxy methyl cellulose, the cationic material is a polymer of diallyl dimethyl ammonium chloride having intrinsic viscosity below 3 dl/g and the anionic retention aid is an inorganic swelling clay.

* * * * *